US005299784A

United States Patent [19]

Schöler et al.

[11] Patent Number: 5,299,784

[45] Date of Patent: Apr. 5, 1994

[54] DEGASSING VESSEL FOR THE VACUMM TREATMENT OF LIQUID STEEL

[75] Inventors: Horst-Dieter Schöler, Duisburg; Hans-Peter Golloch, Quirnbach; Auke Braaksma, Moers, all of Fed. Rep. of Germany

[73] Assignee: Mannesmann Aktiengesellschaft, Düsseldorf, Fed. Rep. of Germany

[21] Appl. No.: 944,213

[22] Filed: Sep. 11, 1992

[30] Foreign Application Priority Data

Sep. 12, 1991 [DE] Fed. Rep. of Germany ..... 4130590

[51] Int. Cl.[5] ..... C21C 7/10

[52] U.S. Cl. ..... 266/210; 266/209

[58] Field of Search ..... 266/208, 209, 210

[56] References Cited

U.S. PATENT DOCUMENTS 3,565,411 2/1971 Grossman et al. ..... 266/210

5,096,164 3/1992 Luven et al. ..... 266/210

FOREIGN PATENT DOCUMENTS 153393 2/1970 Fed. Rep. of Germany .

*Primary Examiner*—Scott Kastler

*Attorney, Agent, or Firm*—Nils H. Ljungman & Associates

[57] ABSTRACT

This invention relates to a degassing vessel for the vacuum treatment of liquid steel, consisting of a lower, middle and upper part. To protect the heater rod, which in the degassing vessel is oriented at a right angle to the center axis, the invention essentially proposes that the middle part has a cylindrical shape with the same radius as the lower part, that in the vicinity of the connection to the upper part there is a flat gas guide surface parallel to the heater rod and at an angle to the cylindrical jacket, and that finally the jacket of the upper part connected to the middle part has the shape of a half-tube, which is closed by a flat surface oriented parallel to the center axis.

20 Claims, 2 Drawing Sheets

(II-II)

DEGASSING VESSEL FOR THE VACUMM TREATMENT OF LIQUID STEEL

BACKGROUND OF THE INVENTION

1. Field of the Invention:

The present invention relates to a degassing vessel for the vacuum treatment of liquid steel, which vessel consists of lower, middle and upper parts. The vessel has a metal jacket, lined on the inside of the vessel with refractory material. Also, the middle part of the vessel, in the portion facing the lower part, has a cylindrical shape having the same radius as the lower part. There is at least one snorkel tube in the floor of the bottom part, which tube is immersed in the melt of a ladle located therebeneath. Also, in the middle part, there is a heater rod oriented at a right angle to the center axis, as well as a charging device. In the upper part, there is a sight hole and an exhaust gas connection, the exhaust gas connection being connected to a vacuum system and oriented at a right angle to the center axis.

2. Background Information:

Degassing vessels such as those described above are generally used for the degassing of liquid steel to achieve extremely low carbon concentrations. Known are two processes which are applied to portions of the liquid steel. In one process, the liquid steel is sucked via a blowpipe into the vacuum chamber, and is discharged through the same blowpipe back into the ladle underneath. In the other process for handling a quantity of liquid steel, the so-called continuous process, the liquid steel is sucked in through a snorkel tube and is continuously returned to the ladle via a second snorkel tube.

To achieve the highest possible production rate, and to avoid thermal losses during the treatment of the liquid steel, the steelmaker usually finds it advantageous to keep the treatment time for the steel as brief as possible. To control and regulate the temperature of the melt and of the furnace, heating devices are located in the vicinity of the center of the vacuum vessel.

As an example, German Patent Publication Published for Opposition Purposes No. 15 33 933 essentially discloses a vacuum chamber with a refractory lining in a vacuum-tight steel casing, which forms a flat hearth in a lower portion, into which a blowpipe for the intake and discharge of the portion of a melt to be treated empties, and which is tapered so that it narrows at the top. In the upper part, there is a heater to preheat the chamber and to keep the melt hot. The chamber is closed by means of a dome-shaped cover made of refractory material with an opening for connection to the vacuum pump system.

It is also known to use vessels which, without any conical taper, are designed to be essentially completely cylindrical and, in the vicinity of the vessel head, have an exhaust gas connection oriented generally at a right angle with respect to the center axis.

Generally, in degassing vessels, particles are entrained by the degassing current. The gas then strikes the surfaces which direct its flow, and individual particles accumulate at these points, on the surfaces. Generally, there tends to be a rather large accumulation of such particles above the heater rod, on the head surface of the degassing vessel, which surface acts as a deflector plate. There, the individual particles form suspended lobes, arranged in sheets. These suspended lobes essentially have a solid consistency, and after the lobes reach a certain size, they break away from the adhering surface at irregular intervals. These broken-off formations, also called skull, fall into the current of liquid steel and thence have a negative effect on the composition of the liquid steel. As the broken-off formations of skull travel through the vacuum vessel, they generally represent a great danger for the heater rods, which generally consist of graphite. Broken fragments of these heater rods can thence result in scrapped melts for steel grades with a low carbon content, on account of unplanned or unintended carburization.

OBJECT OF THE INVENTION

Primarily, the object of the present invention is to avoid the above-mentioned disadvantages and to create a degassing process which, by using simple means, protects the heater rod against mechanical destruction with an efficient configuration of the gas flows in the vessel.

SUMMARY OF THE INVENTION

Essentially, the above object is achieved by the present invention by means of the features discussed hereinbelow. Other advantageous refinements of the present invention are also discussed hereinbelow.

In a degassing vessel according to the present invention, a flat guide plate, or baffle plate, is preferably located above the heater rod. This flat guide plate is preferably at an inclination which conducts the flowing gas to the upper vessel, wherein the upper vessel preferably has a smaller cross-section, or cross-sectional passage for the flow of gases, than the lower vessel. As will be apparent from the detailed description of the preferred embodiments hereinbelow, the simple geometric figures of a circle, semicircle and flat surface are preferably used here instead of a conical taper, which is usually complex and expensive to design and construct.

As a result of the guide plate which narrows the cross section of the middle part of the vessel, the velocity of the gas is accelerated, with the effect that the tendency to form skull is reduced.

In a further refinement of the present invention, the distance between the heater rod and the guide plate is preferably selected so that the inside refractory lining is heated to a temperature at which caking does not yet occur. That is, the distance between the heater rod and the guide plate is preferably selected such that the inside refractory lining will not generally assume a temperature at which caking tends to occur.

The upper portion of the degassing vessel is also preferably constructed from the simple shape elements of a semicircle and straight line. The result is a significant simplification, as well a cost savings with regard to the refractory lining.

The position of the flat surface of the cylindrical upper portion is preferably selected so that the heating rod located underneath it essentially is "in the shadow" of that flat surface, with regard to any solid objects which might fall down. In other words, the flat surface of the cylindrical upper portion and the heating rod are preferably relatively positioned in such way that any solids falling downwardly from that surface will generally avoid contacting the heating rod while falling.

The gas flow passage, or cross-sectional area, of the cylindrical portion of the upper vessel, which consists of the radius in the tubular part corresponding to the middle and lower portion, and is approximately twice that in the flat part of the upper vessel, is preferably selected so that it is essentially the same size as the cross section of the exhaust gas connection. Essentially, the result is that constant flow conditions are achieved by means of this simple construction precisely at the transition from the upper vessel to the exhaust gas tube. The top piece of the upper portion, also designed as a half-tube, generally has only a slight tendency to form encrustations, on account of its favorable shape. If such skull should form, however, it will essentially fall into the liquid steel without any danger to the heater rod; however, almost no skull will usually form on the flat vertical inside surfaces of the upper portion. Of course, the slight change in the alloy when small amounts of the skull fall into the bath of liquid steel can be eliminated by simple metallurgical measures.

The sight tube to observe the bath of liquid steel is protected against thermal radiation from the heater rod, and will therefore have a long useful life.

In a degassing vessel configured according to the present invention, not only are costs saved by reducing the overall weight, in particular the weight of the steel and refractory material used, but there are savings which result from the reduced consumption of graphite. The latter is achieved, among other things, as a result of the fact that the graphite rod can always be turned on, and may thus preclude the need for its extraction from the vessel, as may otherwise be necessary in conventional vessels for the rod to be protected against falling material. As a result of such constant operation, not only is the operational readiness of the rod increased, but maintenance expenses are also decreased.

In summary, one aspect of the invention resides broadly in a degassing vessel for the vacuum treatment of liquid steel, wherein the liquid steel is contained in ladle means and the degassing vessel is configured for being connectingly interfaced with the ladle means, the degassing vessel comprising: a lower portion for being interfaced with the ladle means; a central portion being disposed adjacent to and in an overlying relationship with the lower portion; an upper portion being disposed adjacent to and in an overlying relationship with the central portion; the upper portion comprising exhaust means for venting exhaust gas away from the degassing vessel; each of the lower portion and the upper portion having a general cross-sectional area, the general cross-sectional area of the lower portion being substantially greater than the general cross-sectional area of the upper portion; the central portion being configured for directing exhaust gas to the upper portion from the lower portion; a vertical axis being defined through the degassing vessel; and the central portion comprising a generally flat, planar wall portion being inclined with respect to the vertical axis of the degassing vessel, the generally flat, planar wall portion being configured for directing exhaust gas from the lower portion to the upper portion.

BRIEF DESCRIPTION OF THE DRAWINGS

A preferred embodiment of the present invention is illustrated in the accompanying drawings, wherein.

DESCRIPTION OF THE PREFERRED EMBODIMENTS

Figure 1:
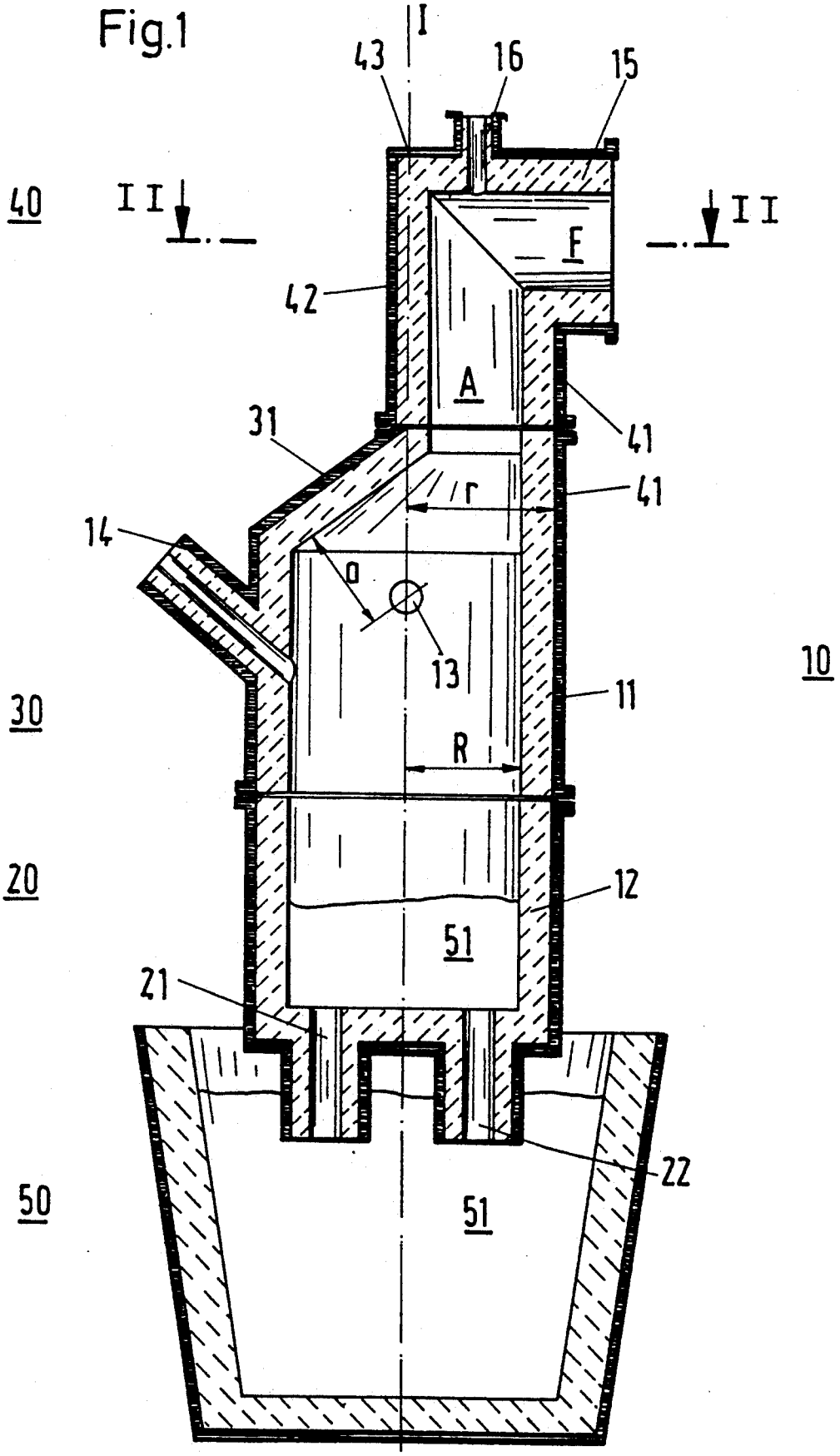
FIG. 1 shows an elevational, cross-sectional view through a degassing vessel.

FIG. 1 shows a degassing vessel 10, essentially consisting of a lower part 20, a middle part 30 and an upper part 40. The degassing vessel 10 has a jacket 11, which is lined on the inside of the vessel with a refractory compound 12.

The lower part 20 has a snorkel tube 21 for the input of melt 51 from a ladle 50, and another snorkel tube 22 for the discharge of the melt 51 back to ladle 50.

The middle part 30 is preferably cylindrical in its lower portion, and is preferably tapered in its upper portion by means of a flat gas guide surface 31. In the cylindrical area of middle part 30, there is preferably a charging device 14 as well as a heater rod 13.

The upper part 40, which sits on top of the middle part 30, preferably assumes the shape, approximately, of half of a tube, as indicated at 41. Half-tube 41 is preferably connected, or spanned, by means of a flat surface 42 running parallel to central axis I, which central axis is defined longitudinally and symmetrically with respect to the lower part 20 and the cylindrical area of middle part 30. The upper part 40 is preferably terminated, or capped, by a top 43 oriented at a right angle to the center axis I. Preferably, there is a sight hole 16 in the top 43.

The upper part 40 empties into an exhaust gas connection 15 having a cross-sectional area, or gas-flow passage F. The cross-sectional area, or gas flow passage, of upper portion 40 is designated A in the passage, and the passage is oriented parallel to the center axis I. As is also shown in FIG. 1, the inside radius of the refractory lining is designated R, and the radius of the vessel jacket is designated r.

Figure 2:
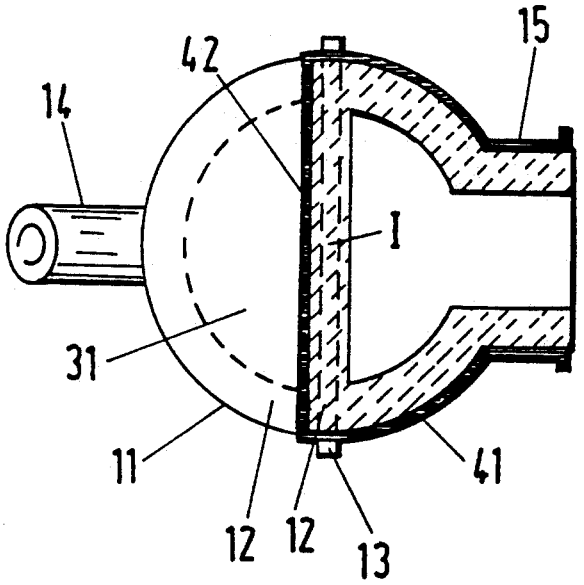
FIG. 2 shows a plan cross-sectional view, taken along line II—II of FIG. 1, through the dome, or roof, of the degassing vessel.

FIG. 2 shows a cross section along line II—II with the exhaust gas connection 15, the tubular portion 41 and the flat surface 42 oriented parallel to the center axis I.

The gas guide surface 31 is illustrated in the plan view of FIG. 2, as well as the jacket 11, refractory lining 12, and charging device 14. As shown, heater rod 13 is preferably oriented substantially at a right angle to the center axis I. Also, as shown, the heater rod 13 is preferably located "in the shadow" of the refractory lining 12 on the flat surface 42. In other words, the flat surface 42 and the heater rod 13 are preferably relatively positioned in such a way that any solids falling downwardly from surface 42 will generally avoid contacting the heating rod while falling. In this manner, heater rod 13 may be considered to be "in the shadow" of flat surface 42, and this feature of the present invention may be most particularly appreciated from a plan view, such as that afforded by FIG. 2.

As has been mentioned heretofore, the flat gas gas guide surface 31 of middle part 30 of vessel 10 is preferably configured such that the flow of gas is conducted effectively to the upper part 40, wherein the cross-sectional area of the passage provided by the upper part is substantially smaller than the cross-sectional area of the passage provided by the cylindrical portion of middle part 30 and by lower part 20. The preferred shape of middle part 30, including flat gas guide surface 31, may be particularly summarized as follows:

a major portion of middle part 30, particularly a portion extending upwardly from the area at which middle part 30 interfaces with lower part 20, is preferably cylindrical;

thus, the uppermost portion of the cylindrical portion of middle part 30 preferably has a circular cross-section;

the very uppermost portion of middle part 30, that is, that portion which interfaces with upper part 40, preferably has a semicircular cross-section, the radius of the semicircular cross-section preferably being essentially the same as the radius of the cylindrical portion of middle part 30;

gas guide surface 31 is preferably characterized by a flat surface having the shape of a semi-ellipse, which surface preferably extends from the straight-line portion of the semicircular cross-section at the uppermost portion of middle part 30 to a single point at the periphery of the circular cross-section of the uppermost portion of the cylindrical portion of middle part 30.

Further, as may be appreciated from the drawings, the flat ellipsoid surface, indicated at 31, is preferably cut at a plane which is oriented at a distinct slope both with respect to the vertical and the horizontal. Thus, the preferred configuration of middle part 30 may be thought of as a shaved-off cylindrical shape, wherein the cutting plane defining the shaved-off shape is inclined and extends through a diameter of the uppermost portion of the cylindrical shape and continues to a single point at the outer periphery of the cylindrical shape, that single point being at an area somewhat lower than the uppermost portion of the cylindrical shape. The resulting inclined plane surface is thus essentially a semi-ellipse, and the cylindrical periphery of the middle part 30 thus essentially extends upward to meet the inclined, semi-ellipsoid plane.

Of course, it should be understood that other shapes or configurations besides the configuration described immediately above may be utilized within the scope of the present invention.

According to a preferred embodiment of the present invention, the angle between the gas guide surface 31 and the central axis I is preferably between about 30 and about 60 degrees. Also, a distance from the flat gas guide surface 31 to heater rod 13, indicated in FIG. 1 as "a", is preferably the same as a radius R defined, in the cylindrical portion of middle part 30, between central axis I and an interior surface of refractory lining 12, which radius R is also shown in FIG. 1. As shown, heater rod 13 preferably intersects central axis I perpendicularly.

Further, the gas flow passage A, or cross-sectional area, of the vertical portion of upper part 40 is preferably between about 0.9 and about 1.1 times the gas flow passage F, or cross-sectional area, of exhaust gas connection 15, and is most preferably about equivalent thereto.

One feature of the invention resides broadly in the degassing vessel for the vacuum treatment of liquid steel, consisting of a lower, middle and upper part, which has a metal jacket, which is lined on the inside of the vessel with refractory material, which, in the middle part in the portion facing the lower part, has a cylindrical shape having the same radius as the bottom part, with at least one snorkel tube in the floor of the bottom part which is immersed in the melt of a ladle located underneath it, with a heater rod in the middle portion oriented at a right angle to the center axis, as well as a charging device, and with a sight hole in the upper part and an exhaust gas connection connected to a vacuum system and oriented at a right angle to the center axis, characterized by the fact that a portion of the jacket 11 of the middle part 30 is designed as a flat surface 31 in the area toward the upper part 40, which flat surface is oriented parallel to the heater rod 13 and runs in the gas flow direction toward the center axis I, that the jacket 11 of the upper part 40 in the area facing the middle part 30 consists of a half-tube with a radius r which is the same as the parts 20, 30, and a flat surface 42 oriented parallel to the center axis I, and in the area facing the exhaust gas connection 15 by an essentially semicircular top 43 oriented parallel to the axis of the exhaust gas connection.

Another feature of the invention resides broadly in the degassing vessel, characterized by the fact that the angle between the flat surface 31 and the center axis I is 30 to 60 degrees.

Yet another feature of the invention resides broadly in the degassing vessel, characterized by the fact that the distance a from the flat surface 31 is the same as the radius R of the maximum distance at a right angle to the heater rod 13 of the refractory lining 12 of the tubular jacket 11.

Still another feature of the invention resides broadly in the degassing vessel, characterized by the fact that the flat surface 42 with a refractory lining 12 on the inside of the vessel is oriented so that, when seen in a plan view of the degassing vessel 10, the heater rod 13 is located in its shadow so that it is protected from pieces falling from the upper part 40.

Another feature of the invention resides broadly in the degassing vessel, characterized by the fact that the flow cross section A of the upper part 40 is of a size which corresponds to 0.9 to 1.1 times the flow cross section F of the exhaust gas connection 15.

Generally, specific components for use in degassing vessels for the vacuum treatment of liquid steel, as well as the general makeup and operation of the vessels themselves, are well-known to those of ordinary skill in the relevant arts. Examples of such components, and discussions of the general makeup and operation of degassing vessels may be found in the following U.S. Pat. Nos.: U.S. Pat. No. 5,011,531 to Takahashi et al., entitled "Method and Apparatus for Degassing Molten Metal Utilizing RH Method"; U.S. Pat. No. 4,979,983 to Nishikawa et al., entitled "Process for Vacuum Degassing and Decarbonization with Temperature Drop Compensating Feature"; U.S. Pat. No. 4,810,286 to Schlichting et al., entitled "Method for Reducing Dissolved Oxygen and Carbon Contents in Molten Steel"; U.S. Pat. No. 4,541,862 to Finkl et al., entitled "Ladle Steelmaking Method and Apparatus"; and U.S. Pat. No. 4,298,376 to Narita et al., entitled "Method for Treating Molten Steel and Apparatus Therefor".

In view of the foregoing disclosure, it will now be appreciated that the present invention relates to a degassing vessel for the vacuum treatment of liquid steel, consisting of a lower, middle and upper part. To protect the heater rod, which in the degassing vessel is oriented at a right angle to the center axis, the invention essentially proposes that the middle part (30) has a cylindrical shape with the same radius (R) as the lower part (20), that in the vicinity of the connection to the upper part (40) there is a flat gas guide surface (31) parallel to the heater rod (13}and at an angle to the cylindrical jacket (11), and that finally the jacket (11) of the upper part (40) connected to the middle part (30) has the shape of a half-tube (41), which is closed by a flat surface (42) oriented parallel to the center axis (1).

All, or substantially all, of the components and methods of the various embodiments may be used in any combination with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The appended drawings, in their entirety, including all dimensions, proportions and/or shapes in at least one embodiment of the invention, are, if applicable, accurate and to scale and are hereby incorporated by reference into this specification.

The invention as described hereinabove in the context of the preferred embodiments is not to be taken as limited to all of the provided details thereof, since modifications and variations thereof may be made without departing from the spirit and scope of the invention.

LIST OF REFERENCE NUMERALS AND LETTERS

10 Degassing vessel
11 Jacket
12 Refractory lining
13 Heater rod
14 Charging device
15 Exhaust gas connection
16 Sight hole
20 Lower part
21 Lifting snorkel tube
22 Discharge snorkel tube
30 Middle part
31 Gas guide surface
40 Upper part
41 Tube (half-tube)
42 Surface
43 Top
50 Ladle
51 Liquid metal
I Center axis
a Distance between heater rod and gas guide surface
A Flow cross section, upper part
F Flow cross section, exhaust gas tube
R Radius of refractory lining
r Radius of vessel jacket

What is claimed is:

1. Degassing vessel for the vacuum treatment of liquid steel, wherein the liquid steel is contained in ladle means and said degassing vessel is configured for being connectingly interfaced with the ladle means, said degassing vessel comprising:

a lower portion for being interfaced with the ladle means;

a central portion being disposed adjacent to and in an overlying relationship with said lower portion;

an upper portion being disposed adjacent to and in an overlying relationship with said central portion;

said upper portion comprising exhaust means for venting exhaust gas away from said degassing vessel;

each of said lower portion and said upper portion having a general cross-sectional area, the general cross-sectional area of said lower portion being substantially greater than the general cross-sectional area of said upper portion;

said central portion being configured for directing exhaust gas to said upper portion from said lower portion;

a vertical axis being defined through said degassing vessel;

said central portion comprising a generally flat, planar wall portion being inclined with respect to the vertical axis of said degassing vessel, said generally flat, planar wall portion being configured for directing exhaust gas from said lower portion to said upper portion;

a heater for providing heat to said degassing vessel;

said heater comprising a heater rod disposed in said central portion of said degassing vessel; and said heater rod being spaced from said planar wall portion at a distance to minimize formation of deposits on said planar wall portion.

2. The degassing vessel according to claim 1, wherein:

said heater rod is oriented parallel to said planar wall portion.

3. The degassing vessel according to claim 5, wherein:

said central portion comprises a generally cylindrical portion, said generally cylindrical portion being disposed directly adjacent said lower portion; and said planar wall portion extends from said generally cylindrical portion of said central portion to said upper portion.

4. The degassing vessel according to claim 3, wherein:

said upper portion comprises a generally vertical portion having a generally semicircular cross-section and a cylindrical wall portion forming a portion of said generally semicircular cross-section;

each of said central portion and said lower portion comprising a cylindrical wall portion;

said cylindrical wall portion of said generally vertical portion of said upper portion, a portion of said cylindrical wall portion of said central portion, and a portion of said cylindrical wall portion of said lower portion being aligned and colinear with respect to one another.

5. The degassing vessel according to claim 4, wherein each of the generally semicircular cross-section of said upper portion and said generally cylindrical portion of said central portion has a radius, the radius of the generally semicircular cross-section of said upper portion being substantially equal to the radius of said generally cylindrical portion of said central portion.

6. The degassing vessel according to claim 5 wherein said heater rod is disposed directly vertically beneath said planar wall portion to minimize contact between said heater rod and deposits falling from above said heater rod.

7. The degassing vessel according to claim 6, wherein:

said exhaust means is configured for being connected to a vacuum system;

said exhaust means comprises an exhaust gas conduit for being connected with the vacuum system; and said exhaust gas conduit extends from an upper area of said upper portion in a direction generally perpendicular to the vertical axis.

8. The degassing vessel according to claim 7, wherein:

said upper portion comprises a cap portion being disposed at an upper area of said upper portion, said cap portion being configured for directing exhaust gas from said vertical portion of said upper portion to said exhaust gas conduit;

said exhaust gas conduit defines an axis along the extent of said exhaust gas conduit, the axis of said exhaust gas conduit being generally perpendicular to the vertical axis of said degassing vessel; and said cap portion is configured to lie in a plane generally parallel to the axis of said exhaust gas conduit.

9. The degassing vessel according to claim 8, wherein said lower portion has a generally cylindrical shape.

10. The degassing vessel according to claim 9, wherein said generally vertical portion of said upper portion comprises a vertical wall portion, having a generally flat surface, being oriented parallel to the vertical axis.

11. The degassing vessel according to claim 10, wherein said planar wall portion extends from an upper area of said general cylindrical portion of said central portion to a lower area of said vertical wall portion of said upper portion and being configured to intersect said vertical wall portion.

12. The degassing vessel according to claim 11, wherein said heater rod is oriented perpendicularly with respect to the vertical axis.

13. The degassing vessel according to claim 12, further comprising:

said planar wall portion of said central portion being inclined with respect to the vertical axis at an angle of between about 30 degrees and about 60 degrees;

a distance "a" being defined between said planar wall portion and said heater rod;

said vertical axis of said degassing vessel being a symmetrical axis with respect to the generally cylindrical portion of said central portion and to said lower portion;

in said generally cylindrical portion of said central portion, a radius R being defined, perpendicularly to the vertical axis, between the vertical axis and said inner jacket portion;

said distance "a" being substantially equal to said radius R;

said heater rod being configured to intersect the vertical axis;

said vertical wall portion of said upper portion defining an interior surface of said vertical wall portion;

said vertical wall portion of said upper portion being disposed in an overlapping relationship with respect to said heater rod such that said heater rod is horizontally offset from the interior surface of said vertical wall portion of said upper portion;

said vertical wall portion of said upper portion defining an exhaust gas flow cross-sectional area A for the flow of exhaust gas therethrough;

said exhaust gas conduit defines an exhaust gas flow cross-sectional area F for the flow of exhaust gas therethrough;

said exhaust gas flow cross-sectional area A is equal to between about 0.9 times and about 1.1 times said exhaust gas flow cross-sectional area F;

said exhaust gas flow cross-sectional area A being substantially equal to said exhaust gas flow cross-sectional area F;

said cap portion having a generally semicircular shape;

each of said lower, central and upper portions defining an external portion and an interior surface disposed within the external portion;

a metal jacket portion being disposed at the external portion of each of said lower, central and upper portions;

a lining portion for being lined along on the interior surface of each of said lower, central and upper portions;

said lining portion comprising a refractory material;

said lower portion having a radius, the radius of said lower portion and the radius of said generally cylindrical portion being substantially equal;

said heater rod being configured for extending through said central portion;

snorkel tube means for communicating between said lower portion and the ladle means and for directing melt between said lower portion and the ladle means;

said snorkel tube means comprising at least one snorkel tube;

said snorkel tube means comprising two snorkel tubes;

one of said two snorkel tubes being configured for directing melt from the ladle means to said degassing vessel;

the other of said two snorkel tubes being configured for directing melt from said degassing vessel to the ladle means;

said degassing vessel having an interior, the interior being defined by the interior surfaces of said lower, central and upper portions;

sight hole means being disposed in said upper portion, said sight hole means being configured for affording viewing of the interior of said degassing vessel;

said sight hole means comprising a single sight hole being disposed in said cap portion of said upper portion;

said single sight hole being oriented generally parallel to the vertical axis of said degassing vessel;

means for charging the interior of said degassing vessel;

said charging means being configured to feed into said generally cylindrical portion of said central portion;

said planar wall portion having a generally semi-ellipsoid shape;

said generally cylindrical portion of said central portion defining a periphery;

said vertical wall portion of said upper portion having a base at a lower area of said upper portion; and said planar wall portion being configured to extend from a point at the periphery of said generally cylindrical portion of said central portion to the base of said vertical wall portion of said upper portion.

14. Degassing vessel for the vacuum treatment of liquid steel, wherein the liquid steel is contained in ladle means and said degassing vessel is configured for being connectingly interfaced with the ladle means, said degassing vessel comprising:

a lower portion for being interfaced with the ladle means;

a central portion being disposed adjacent to and in an overlying relationship with said lower portion;

an upper portion being disposed adjacent to and in an overlying relationship with said central portion;

said upper portion comprising exhaust means for venting exhaust gas away from said degassing vessel;

each of said lower portion and said upper portion having a general cross-sectional area, the general cross-sectional area of said lower portion being substantially greater than the general cross-sectional area of said upper portion;

said central portion being configured for directing exhaust gas to said upper portion from said lower portion;

a vertical axis being defined through said degassing vessel;

said central portion comprising a generally flat, planar wall portion being inclined with respect to the vertical axis of said degassing vessel, said generally flat, planar wall portion being configured for directing exhaust gas from said lower portion to said upper portion;

a heater for providing heat to said degassing vessel;

said heater comprising a heater rod disposed in said central portion of said degassing vessel; and said heater rod being disposed directly vertically beneath said planar wall portion to minimize contact between said heater rod and deposits falling from above said heater rod.

15. The degassing vessel according to claim 15, wherein: said upper portion comprises a generally vertical portion;

said generally vertical portion of said upper portion comprises a vertical wall portion, having a generally flat surface, being oriented parallel to the vertical axis of said degassing vessel;

said vertical wall portion of said upper portion defines an interior surface of said vertical wall portion; and said vertical wall portion of said upper portion is disposed in an overlapping relationship with respect to said heater rod such that said heater rod is horizontally offset from the interior surface of said vertical wall portion of said upper portion, such that contact between said heater rod and deposits falling from said vertical wall portion of said upper portion is minimized.

16. The degassing vessel according to claim 15, wherein said generally vertical portion of said upper portion has a generally semicircular cross-section.

17. The degassing vessel according to claim 16, wherein:

said central portion comprises a generally cylindrical portion, said generally cylindrical portion being disposed directly adjacent said lower portion; and said planar wall portion extends from an upper area of said general cylindrical portion of said central portion to a lower area of said vertical wall portion of said upper portion and is configured to intersect said upper wall portion.

18. Degassing vessel for the vacuum treatment of liquid steel, wherein the liquid steel is contained in ladle means and said degassing vessel is configured for being connectingly interfaced with the ladle means, said degassing vessel comprising:

a lower portion for being interfaced with the ladle means;

a central portion being disposed adjacent to and in an overlying relationship with said lower portion;

an upper portion being disposed adjacent to and in an overlying relationship with said central portion;

said upper portion comprising exhaust means for venting exhaust gas away from said degassing vessel;

each of said lower portion and said upper portion having a general cross-sectional area, the general cross-sectional area of said lower portion being substantially greater than the general cross-sectional area of said upper portion;

said central portion being configured for directing exhaust gas to said upper portion from said lower portion;

a vertical axis being defined through said degassing vessel;

said central portion comprising a generally flat, planar wall portion being inclined with respect to the vertical axis of said degassing vessel, said generally flat, planar wall portion being configured for directing exhaust gas from said lower portion to said upper portion;

said upper portion comprising a generally vertical portion having a generally semicircular cross-section and a cylindrical wall portion forming a portion of said generally semicircular cross-section;

each of said central portion and said lower portion comprising a cylindrical wall portion; and said cylindrical wall portion of said generally vertical portion of said upper portion, a portion of said cylindrical wall portion of said central portion and a portion of said cylindrical wall portion of said lower portion being aligned and colinear with respect to one another.

19. The degassing vessel according to claim 18, wherein said generally vertical portion of said upper portion comprises a vertical wall portion, having a generally flat surface, being oriented parallel to the vertical axis.

20. The degassing vessel according to claim 19, wherein:

said planar wall portion extends from an upper area of said general cylindrical portion to a lower area of said vertical wall portion of said upper portion and is configured to intersect said upper wall portion; and said planar wall portion has a generally semi-ellipsoid shape;

said generally cylindrical portion of said central portion defines a periphery;

said vertical wall portion of said upper portion has a base at a lower area of said upper portion; and said planar wall portion is configured to extend from a point at the periphery of said generally cylindrical portion of said central portion to the base of said vertical wall portion of said upper portion.

* * * * *

UNITED STATES PATENT AND TRADEMARK OFFICE

CERTIFICATE OF CORRECTION

PATENT NO. : 5,299,784

DATED : April 5, 1994

INVENTOR(S) : Horst-Dieter SCHÖLER, Hans-Peter GOLLOCH and Auke BRAAKSMA

It is certified that error appears in the above-indentified patent and that said Letters Patent is hereby corrected as shown below:

In column 8, line 24, Claim 3, after 'claim', delete "5" and insert --2--.

In column 11, line 27, Claim 15, after 'claim', delete "15" and insert --14--.

Signed and Sealed this

Fifteenth Day of October, 1996

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,299,784

DATED : April 5, 1994

INVENTOR(S) : Horst-Dieter SCHÖLER, Hans-Peter Golloch, and Auke BRAAKSMA

It is certified that error appears in the above-indentified patent and that said Letters Patent is hereby corrected as shown below:

On the title page, item [54], after 'THE', delete "VACUMM" and insert --VACUUM--.

In column 1, line 1, after 'THE', delete "VACUMM" and insert --VACUUM--.

Signed and Sealed this

Twelfth Day of November, 1996

*Attest:*

*Attesting Officer*

Bruce Lehman

BRUCE LEHMAN

*Commissioner of Patents and Trademarks*